United States Patent [19]

Kolton et al.

[11] Patent Number: 4,884,726

[45] Date of Patent: Dec. 5, 1989

[54] HANGER FOR SUPPORTING PLURAL GARMENTS

[75] Inventors: Chester Kolton, Westfield; Stuart S. Spater, Livingston, both of N.J.

[73] Assignee: B & G Plastics, Inc., New York, N.Y.

[21] Appl. No.: 234,212

[22] Filed: Aug. 18, 1988

[51] Int. Cl.[4] ..... A47G 25/48

[52] U.S. Cl. ..... 223/91; 24/489

[58] Field of Search ..... 223/88, 90, 91, 92, 223/93, 96; 24/489, 511, 487

[56] References Cited

U.S. PATENT DOCUMENTS 3,292,223 12/1966 Esposito, Jr. ..... 223/93 X 4,335,838 6/1982 Bisk et al. ..... 223/96 X

FOREIGN PATENT DOCUMENTS 2018883 10/1979 United Kingdom ..... 223/96

*Primary Examiner*—Werner H. Schroeder

*Assistant Examiner*—Jodi A. Tokar

*Attorney, Agent, or Firm*—Robin, Blecker, Daley & Driscoll

[57] ABSTRACT

A hanger for the hanging of plural garments has a body portion for hanging a first garment, the body portion having a central opening, a hook portion extending outwardly of the body portion and a cross-member cooperative with the body portion to bound the central opening and snap-hinge units, each in the form of an integral body for the hanging of a second garment. Each snap-hinge unit has first and second hinge members for releasable retention of the second garment, a snap-hinge selectively operable for biasing the first and second hinge members into such retention of the second garment in one state thereof and for biasing the first and second hinge members to release the second garment from such retention in a second state thereof, and detent structure for securement of the snap-hinge units to the cross-member, irrespective of the state of the snap-hinge.

12 Claims, 4 Drawing Sheets

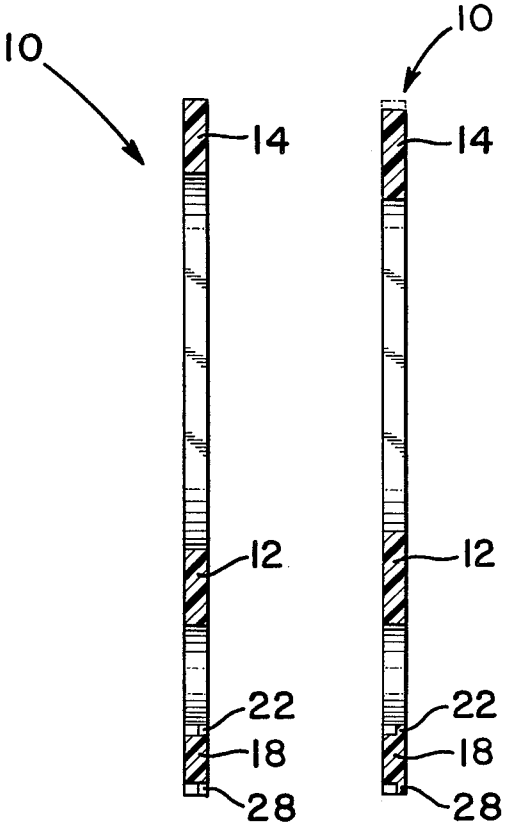
FIG. 6
FIG. 5
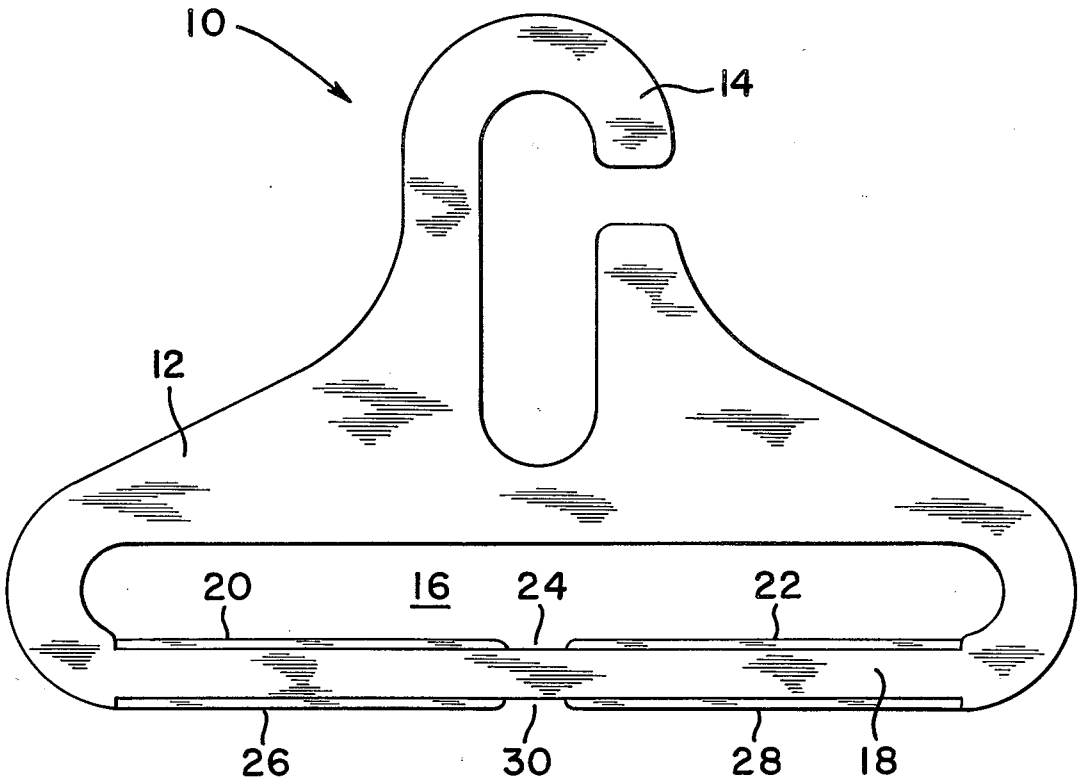
FIG. 4

HANGER FOR SUPPORTING PLURAL GARMENTS

FIELD OF THE INVENTION

This invention relates generally to garment hangers and pertains more particularly to garment hangers for the hanging of plural garments.

BACKGROUND OF THE INVENTION

A variety of hangers for the hanging of plural garments is presently known, the garments being typically companion parts of a given outfit, e.g., the jacket and trousers of a man's suit or the jacket and skirt of a woman's suit. The hanger conventionally has a main or body part with a hook portion for the hanging of the hanger from a support rod, the body part further defining a central opening bounded in part by a cross-member. The body part receives and support the first garment and the cross-member receives and supports the second garment. In widely known such hangers, the cross-member supports the second garment simply by passing the same through the central opening in overlapped relation to the cross-member.

More interactive such hangers for plural garment support are known, wherein the second garment is positively supported by engagement of an end thereof by biased jaw members associated with the cross-member. One such more interactive hanger construction is seen in Esposito, Jr. U.S. Pat. No. 3,292,223, entitled "Integral Snap-Action Clips" and issued on Feb. 20, 1966. This hanger is seen as relevant to the invention herein, to the extent that a snap-hinge is employed in the support of such second garment from a hanger, as is shown in FIG. 7 of the '223 patent. In the '223 patent approach, the cross-member of the hanger is ensnared within the snap-hinge jointly with jaw member engagement of the second garment. An advantage, other than the positive retention of the second garment, resides in that the hanger and snap-hinge attachment may be separately shipped and inventoried. However, applicants herein see a disadvantage in the '223 patent hanger in that the snap-hinges become readily separated from the hanger proper once a customer opens the snap-hinge, such as when removing the second garment to try it on or to more closely inspect it.

SUMMARY OF THE INVENTION

The present invention has as its principal object the provision of improved such more interactive hangers for the hanging of plural garments.

A more particular object of the invention is to provide an improved hanger of the type employing snap-hinges for the hanging of such second garment.

In attaining the foregoing and other objects, the invention provides, in combination, for the hanging of plural garments: a hanger having a body portion for hanging a first garment, the body portion having a central opening and a hook portion extending outwardly of the body portion and a cross-member bounding the central opening; and snap-hinge units, each in the form of an integral body for the hanging of a second garment and comprising first and second jaw members for releasable retention of the second garment, a snap-hinge selectively operable for biasing the first and second jaw members into such retention of the second garment in one state thereof and for biasing the first and second jaw members to release the second garment from such retention in a second state thereof, and detent structure for securement of the snap-hinge units to the cross-member, irrespective of the state of the snap-hinge.

In a particularly preferred embodiment, the cross-member is configured for facilitating both assembly and release of the snap-hinge means therefrom when desired. To this end, the cross-member defines a track along its periphery having a discontinuity, the track being matable with the detent structure to effect such securement of the snap-hinge units to the cross-member, such track discontinuity being effective to permit joinder of the detent structure and the cross-member and release of the detent structure from such joinder with the cross-member.

More specifically, in the preferred embodiment, the cross-member is elongate, the track discontinuity is of first longitudinal dimension, and the detent structure has a first dimension substantially equal to the track discontinuity first dimension. The cross-member exhibits a second, lateral dimension between its outer surfaces bounding the tracks and the detent structure includes a slot of substantially such second dimension of the cross-member. Further, the detent structure defines an opening into the slot substantially equal to a lateral dimension of the cross-member at the track discontinuity.

As is discussed below in detail, such mutually-related dimensions of the cross-member and the detent structure of the snap-hinge units facilitate joinder and release thereof.

The foregoing and other objects and features of the invention will be further understood from the following detailed description of preferred embodiments thereof and from the drawings wherein like reference numerals identify like components and parts throughout.

DESCRIPTION OF THE DRAWINGS

FIG. 4 is a rear elevation of the hanger of FIG. 1.

FIG. 5 is a sectional view of the FIG. 1 hanger as would be seen from plane V—V of FIG. 1.

FIG. 6 is a sectional view of the FIG. 1 hanger as would be seen from plane VI—VI of FIG. 1.

DESCRIPTION OF PREFERRED EMBODIMENTS AND PRACTICES

Figure 3:
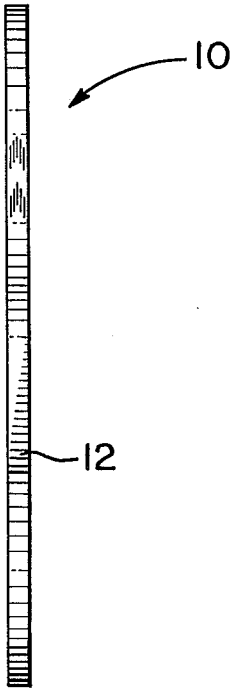
FIG. 3 is a right side elevation of the hanger of FIG. 1.
Figure 1:
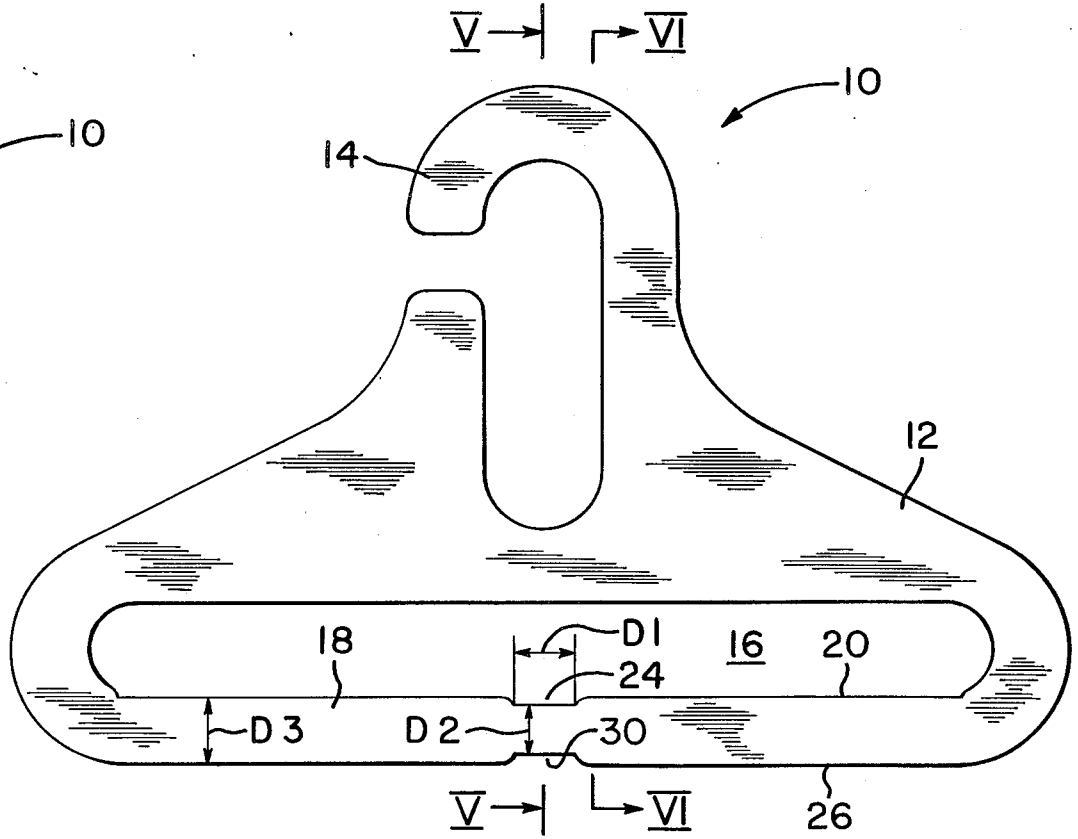
FIG. 1 is a front elevation of a hanger in accordance with the invention.
Figure 2:
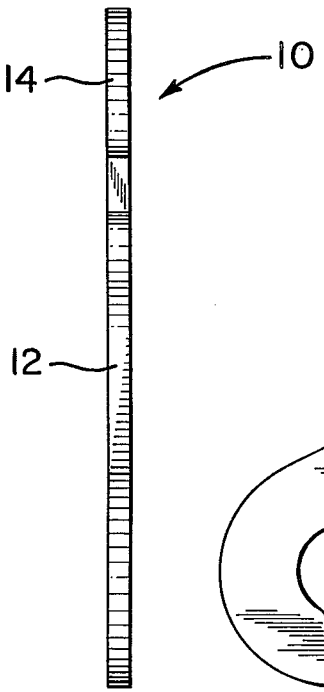
FIG. 2 is a left side elevation of the hanger of FIG. 1.

Referring to FIGS. 1-6, hanger 10 is integrally formed of a suitable plastic material and includes a body portion 12 for hanging a first garment, as above alluded to, typically the jacket of a two-piece outfit. Body portion 12 has a hook portion 14 extending outwardly thereof, for the hanging of hanger 10 on a display support rod (not shown). Body portion 12 further includes a central opening 16 and a cross-member 18 bounding the central opening.

Cross-member 18 has upper outer surface 20 immediately bounding opening 16, including track 22 with central track discontinuity 24, and lower outer surface 26, distal from opening 16, including track 28 with central track discontinuity 30. The cross-member is elongate and the track discontinuities 24 and 30 are each of first longitudinal dimension D1. Each of tracks 22 and 28 has a lateral dimension D2 at the locations of such track discontinuities. A lateral dimension D3 applies as between upper and lower outer surfaces 20 and 26 of cross-member 18.

Figure 9:
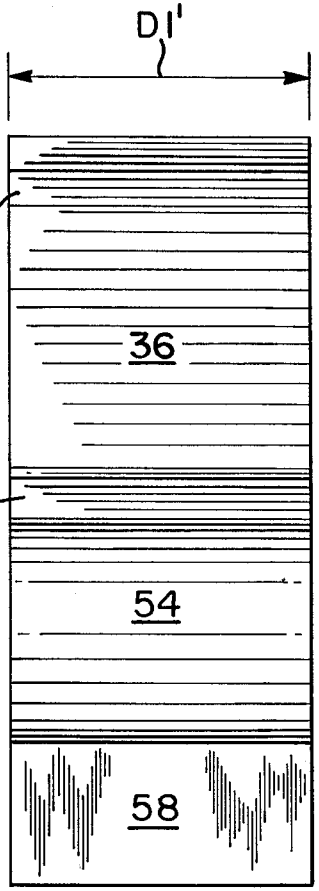
FIG. 9 is a right side elevation of the FIG. 7 snap-hinge unit.
Figure 7:
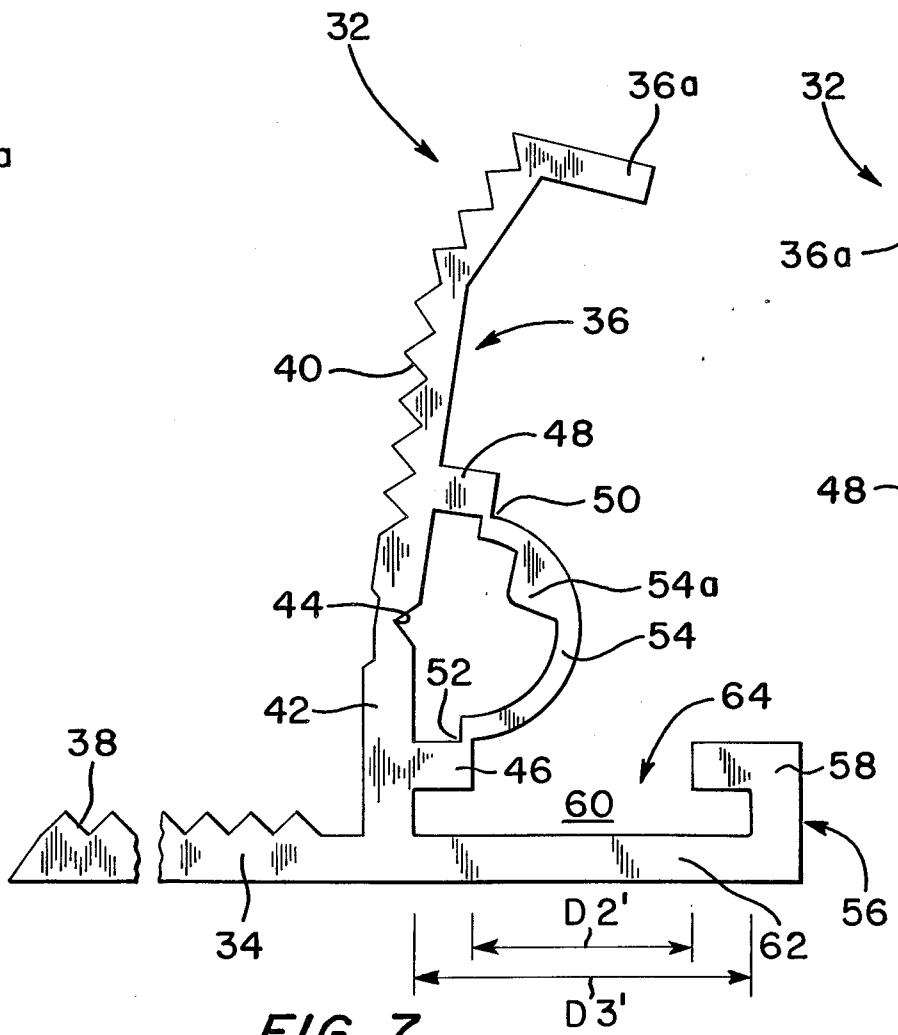
FIG. 7 is a side elevation of a snap-hinge unit in accordance with the invention in open state.
Figure 8:
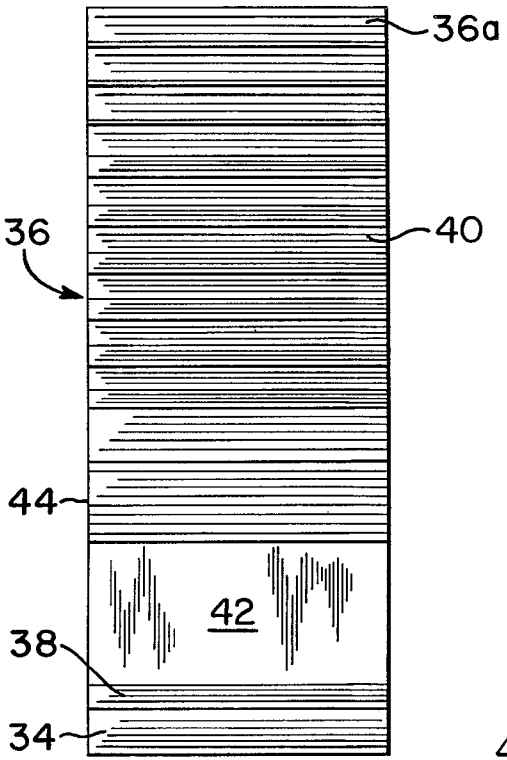
FIG. 8 is a left side elevation of the FIG. 7 snap-hinge unit.

Turning now to FIGS. 7–9, snap-hinge unit 32 is in the form of an integral plastic body for the hanging of a second garment and has first and second jaw (hinge) members 34 and 36 for releasable retention of such second garment. Jaw member 36 has canted end piece **36*a* and the jaw members define respective serations or interfitting teeth 38 and 40 for retentive gripping of the second garment. Jaw member 34 has a post 42 extending upwardly therefrom, leading to first hinge 44 continuous with jaw member 36. Arms 46 and 48 extend in common outward direction, respectively from post 42 and jaw member 36 as illustrated, aside first hinge 44**.

Second and third hinges 50 and 52 are associated with arms 46 and 48, respectively, and a snap-hinge in the form of arcuate bias spring 54 has its ends at such arms and bridges first hinge 44. Stiffening section **54*a* is formed with spring 54** to extend interiorly thereof for lessening deterioration of the spring with repeated opening and closing of the hinge unit.

Detent structure 56 includes arm 46 at its leftward side and inverted L-shaped member 58 at its rightward side. Arm 46 and member 58 overhang detent slot 60, which has dimension D3'. Slot 60 is further bounded by base 62 of dimension D1', which is in common planar disposition with jaw member 34. An opening 64 of dimension D2' provides entry into slot 60.

The dimensions D1', D2' and D3' have relation to dimensions D1, D2 and D3 now discussed in connection with FIGS. 10 and 11 and assembly and release of the hanger and snap hinge units.

Figure 11:
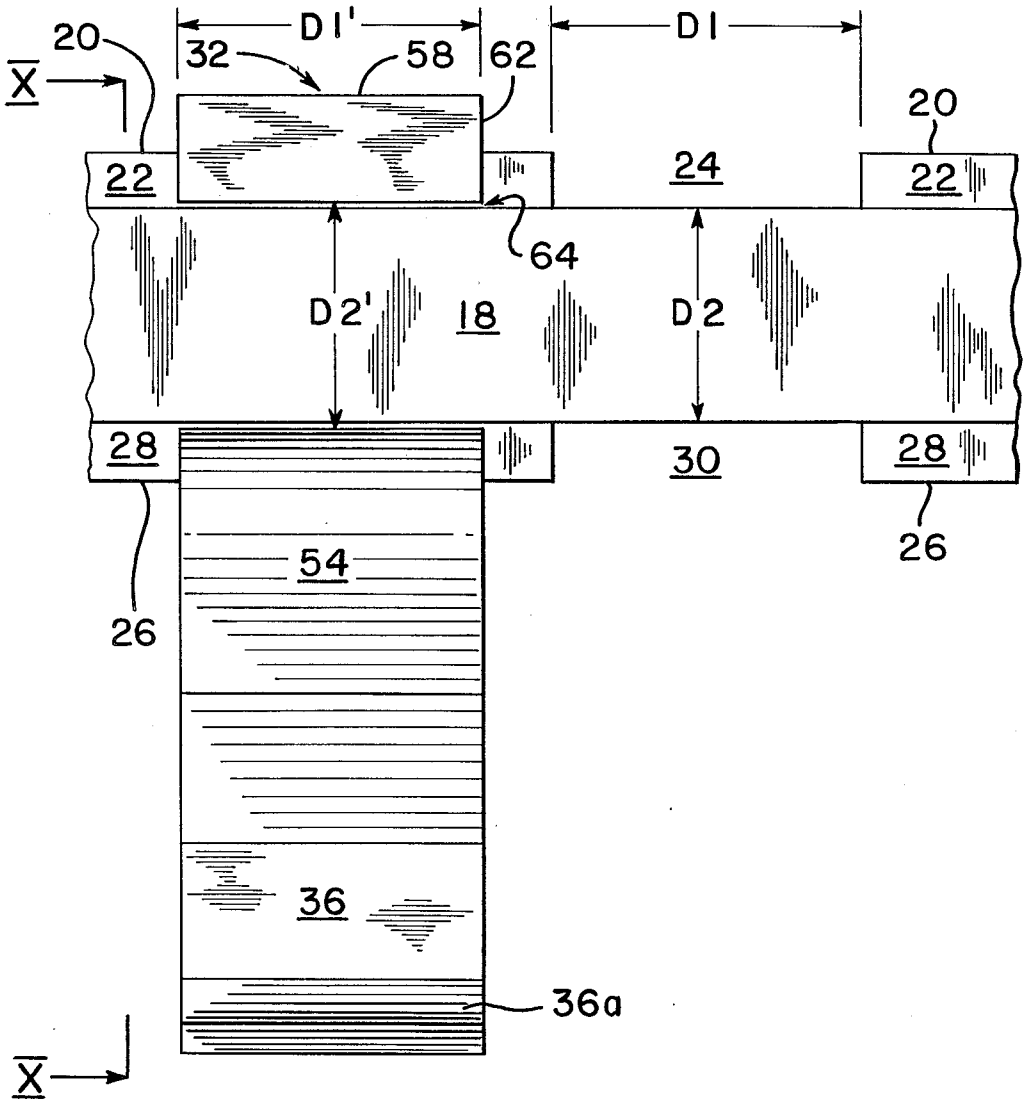
FIG. 11 depicts the FIG. 10 assembly as would be seen looking a the right side of FIG. 10.

Considering FIG. 11, snap-hinge unit 32 is shown assembled with cross-member 18. This assembly was reached by placing base 62 of the snap-hinge unit in registry with track discontinuities 24 and 30, such that L-shaped member 58 is at discontinuity 24 and opening 64 bridges cross-member 18 at its dimension D2. At such juncture, since dimension D1' is selected to be slightly less than or substantially equal to dimension D1 and since dimension D2 is selected to be slightly less than or substantially equal to dimension D2', cross-member 18 can enter slot 60 through opening 64. Then, since dimension D3 is selected to be slightly less than or substantially equal to dimension D3', the snap-hinge unit may be displaced rightwardly or leftwardly from the track discontinuity registration position to become assembled with cross-member 18. Further, by selection of dimension D3 to be larger than dimension D2', such assembly becomes retentive as against movement of the snap-hinge unit outwardly of the plane of FIG. 11.

For release of the snap-hinge unit from cross-member 18, one simply displaces the same into registration with track discontinuities 24 and 30 and reverses the above operation.

Figure 10:
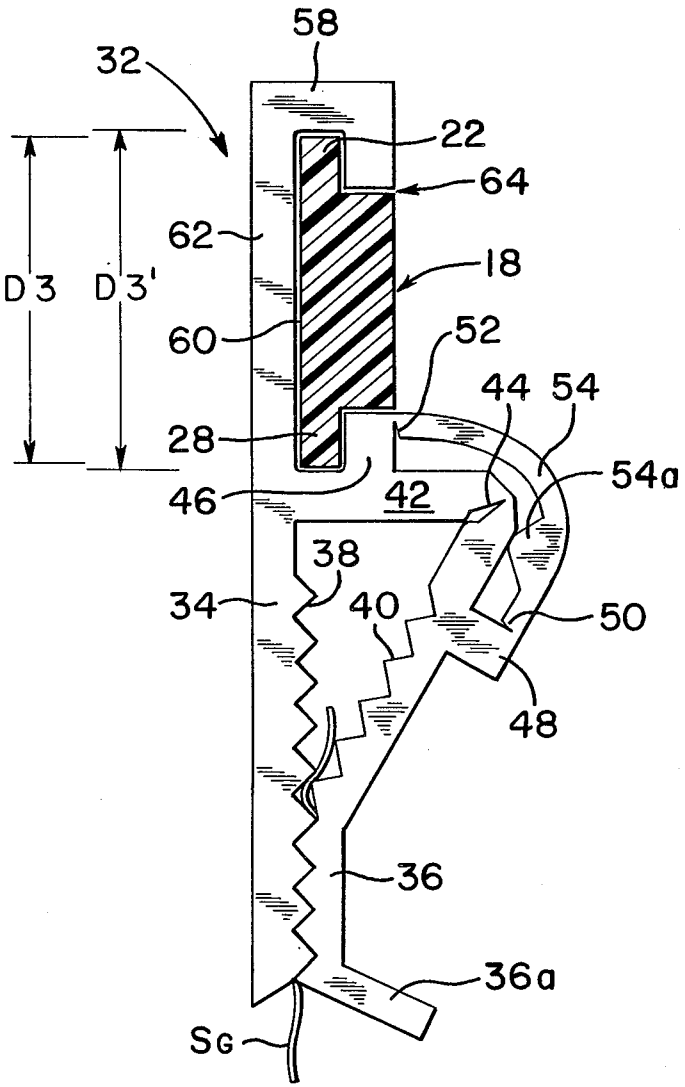
FIG. 10 is a side elevation of the FIG. 7 snap-hinge unit in assembly with the cross-member of the FIG. 1 hanger and in closed state.

Turning to FIG. 10, it will be appreciated that such assembly and release are accomplished irrespectively of the state of snap-hinge unit 32. In FIG. 10, the snap-hinge unit is shown in its closed state and in retentive engagement with tracks 22 and 28 of cross-member 18 and with second garment SG. As will be appreciated, opening of the snap-hinge will have no effect on the retention thereof by cross-member 18.

Operation of snap-hinge unit 32 itself is well addressed in the Esposito patent, above referenced, to which incorporating reference is hereby made. In brief, spring 54 operates in spring fashion, over its expanded cross-section, except for stiffening section **54*a*, to exert bias, when in unstable state, to force its associated jaw members into respective open or closed states in accordance with the sense, opening or closing, force applied thereto. As is shown in FIG. 10, in the configuration of the snap-hinge herein, i.e., inclusive of stiffening section 54*a*, such section nests conveniently in the space provided between spring 54 and jaw member 36** in the closed state of the spring-hinge unit.

Various changes in construction and modifications to practice may be introduced without departing from the invention. The foregoing detailed discussion of preferred embodiments and practices will accordingly be understood to be in an illustrative and not in a limiting sense. The true spirit and scope of the invention is set forth in the following claims.

What is claimed is:

1. In combination, for the hanging of plural garments:

(a) a hanger having a body portion for hanging a first garment, said body portion having a central opening, a hook portion extending outwardly of said body portion and a cross-member, said body portion and said cross-member bounding said central opening; and (b) snap-hinge means in the form of an integral body for the hanging of a second garment, comprising (1) first and second hinge members for releasable retention of said second garment, (2) a snap-hinge selectively operable for biasing said first and second hinge members into such retention of said second garment in one state thereof and for biasing said first and second hinge members to release said second garment from such retention in a second state thereof, and (3) detent means for securement of said snap-hinge means to said cross-member irrespective of the state of said snap-hinge.

2. The invention claimed in claim 1 wherein said cross-member is further configured for facilitating release of said snap-hinge means therefrom when desired.

3. The invention claimed in claim 2 wherein said cross-member defines a track along its periphery having a discontinuity, said track being matable with said detent means to effect such securement of said snap-hinge means to said cross-member, such track discontinuity being configured to permit said, joinder of said detent means and said cross-member and a release of said detent means from such joinder with said cross-member.

4. The invention claimed in claim 3 wherein said cross-member is elongate, wherein said track discontinuity is of first longitudinal dimension, and wherein said detent means has a first dimension substantially equal to said track discontinuity first dimension to permit such joinder and release of said detent means and said cross-member.

5. The invention claimed in claim 4 wherein said cross-member has first and second outer surfaces, each defining such track therealong, said first outer surface bounding said central opening, said detent means includes a slot exhibiting a first dimension substantially equal to the width of said cross-member between said first and second outer surfaces at a location other than at said track discontinuity.

6. The invention claimed in claim 5 wherein said detent means defines an opening into said slot, said slot exhibiting a second dimension across said opening, said second slot dimension being substantially equal to the width of said cross-member between said first and second outer surfaces at said track discontinuity.

7. In combination, for the hanging of plural garments:

(a) a hanger having a body portion for hanging a first garment, said body portion having a central opening, a hook portion extending outwardly of said body portion and a cross-member, said body portion and said cross-member bounding said central opening; and (b) snap-hinge means in the form of an integral body for the hanging of a second garment, comprising (1) first and second hinge members for releasable retention of said second garment, (2) a snap-hinge selectively operable for biasing said first and second hinge members into such retention of said second garment in one state thereof and for biasing said first and second hinge members to release said second garment from such retention in a second state thereof, said snap-hinge including a spring member having a stiffening section formed over an extent thereof and extending interiorly of said spring member toward said second hinge member, said spring member being resilient over the extent thereof excluding said stiffening section, and (3) detent means for securement of said snap-hinge means to said cross-member.

8. The invention claimed in claim 7 wherein said cross-member is configured for facilitating securement of said snap-hinge means to said cross-member and release of said snap-hinge means therefrom.

9. The invention claimed in claim 8 wherein said cross-member defines a track along its periphery having a discontinuity, said track being matable with said detent means to effect such securement of said snap-hinge means to said cross-member, such track discontinuity being configured to permit said joinder of said detent means and said cross-member and said release of said detent means from such joinder with said cross-member.

10. The invention claimed in claim 9 wherein said cross-member is elongate, wherein said track discontinuity is of first longitudinal dimension, and wherein said detent means has a first dimension substantially equal to said track discontinuty first dimension to permit such joinder and release of said detent means and said cross-member.

11. The invention claimed in claim 10 wherein said cross-member has first and second outer surfaces, each defining such track therealong, said first outer surface bounding said central opening, said detent means includes a slot exhibiting a first dimension substantially equal to the width of said cross-member between said first and second outer surfaces at a location other than at said track discontinuity.

12. The invention claimed in claim 11 wherein said detent means defines an opening into said slot, said slot exhibiting a second dimension across said opening, said second slot dimension being substantially equal to the width of said cross-member between said first and second outer surfaces at said track discontinuity.

* * * * *